United States Patent [19]

Litzén

[11] Patent Number: 4,544,095

[45] Date of Patent: Oct. 1, 1985

[54] METHOD FOR ATOMIZATION AND DEVICE FOR CARRYING OUT THE METHOD

[75] Inventor: Karl-Axel Litzén, Bromma, Sweden

[73] Assignee: Boliden Aktiebolag, Stockholm, Sweden

[21] Appl. No.: 477,134

[22] Filed: Mar. 21, 1983

[30] Foreign Application Priority Data

Mar. 31, 1982 [SE] Sweden ..... 8202066

[51] Int. Cl.[4] ..... B05B 7/06

[52] U.S. Cl. ..... 239/8; 239/422; 239/424; 239/428; 239/433

[58] Field of Search ..... 239/419, 420, 422, 424, 239/428, 433, 419.3, 423, 406, 400, 8

[56] References Cited

U.S. PATENT DOCUMENTS

| | | | |
|---|---|---|---|
| 61,632 | 1/1867 | Moody | 239/422 |
| 1,118,278 | 11/1914 | Greathead | 239/405 |
| 1,569,805 | 1/1926 | Hebert | 239/400 |
| 1,575,671 | 3/1926 | Beanes | 239/405 |
| 2,658,800 | 11/1953 | Collinson . | |
| 4,284,242 | 8/1981 | Randell | 239/422 |

FOREIGN PATENT DOCUMENTS

| | | |
|---|---|---|
| 93485 | 8/1897 | Fed. Rep. of Germany . |
| 567291 | 12/1932 | Fed. Rep. of Germany . |
| 912732 | 6/1954 | Fed. Rep. of Germany . |
| 260433 | 3/1949 | Switzerland . |
| 979102 | 1/1965 | United Kingdom . |
| 1096551 | 12/1967 | United Kingdom . |

*Primary Examiner*—Andres Kashnikow
*Assistant Examiner*—James R. Moon, Jr.
*Attorney, Agent, or Firm*—Brumbaugh, Graves, Donohue & Raymond

[57] ABSTRACT

Liquid fuel, particularly slurry-type fuel, such as coal-water, slurry or coal-oil slurries, is atomized by bringing the fuel into contact with gas under pressure in an atomizing nozzle (1). To this end, a continuous stream of fuel is passed through a channel (17) of circular cross-section. The stream of fuel is accelerated in the channel, adjacent the outlet end of the nozzle, and is preliminarily disintegrated by means of at least one first stream of gas under pressure directed inwardly against the outside of the fuel stream. The fuel is finally atomized by directing at least one second stream of gas under pressure outwardly against the inside of the accelerated and preliminarily disintegrated fuel stream, substantially immediately after said stream exits from the nozzle.

5 Claims, 1 Drawing Figure

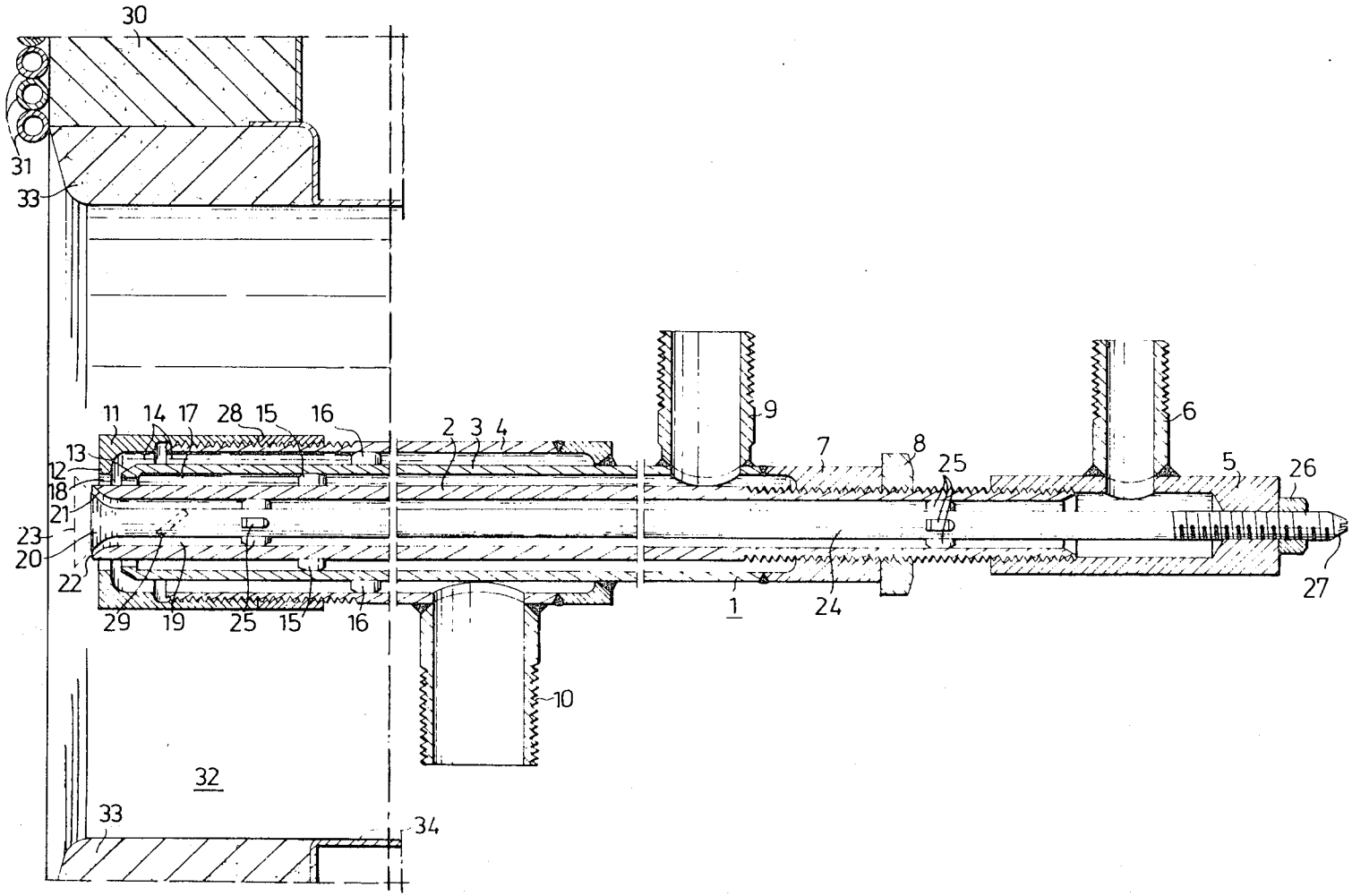
27
26
5
6
25
8
7
24
9
1
10
4
3
2
34
16
16
15
15
28
25
32
17
19
14
29
30
11
33
13
12
18
21
22
23
20
31
33

METHOD FOR ATOMIZATION AND DEVICE FOR CARRYING OUT THE METHOD

The present invention relates to a method for atomizing liquid fuel, particularly liquid fuel of the slurry type, such as coal-water slurries or coal-oil slurries, in which the fuel is brought together in a nozzle with gas under pressure. The invention also relates to a nozzle for atomizing such liquid fuel with the aid of gas under pressure, and to the use of a nozzle according to the invention in atomizing slurry-type liquid fuels, particularly coal-water slurries.

Increasing oil prices have made the use of solid fuels, especially coal, particularly interesting. In this respect it is often suitable to incorporate the solid fuel in a pumpable slurry, i.e. a more or less stable mixture of solid pulverized fuel and a non-combustible or combustible liquid, such as water or oil, methanol, or ethanol respectively. The use of slurry-type fuels, however, is encumbered with certain drawbacks. Among these is the heavy wearing action exerted by the solid fuel particles on the surfaces of conventional atomizing or distributing nozzles, and the difficulty, when using conventional nozzles, of burning carbon-water slurries in the absence of simultaneous back-up combustion with the aid of, for example, oil.

The object of the present invention is to provide a method and apparatus with which the aforementioned drawbacks can be at least substantially overcome.

To this end it is proposed that when carrying out a method of the aforementioned kind, a continuous flow of said fuel is passed through a channel of circular cross-section and is accelerated and preliminarily disintegrated therein at a location adjacent the outlet end of the nozzle, by means of at least one first stream of gas under pressure directed inwardly against the outside of said flow of fuel, and that atomization of the fuel is finalized by directing at least one second stream of gas under pressure outwardly onto the inside of the accelerated and preliminarily disintegrated fuel flow, substantially immediately after the fuel exits from said nozzle. By proceeding in this manner, the work of disintegrating and atomizing the fuel in said fuel flow is effected in a fashion which is favourable to the nozzle and, furthermore, to a large extent at a location lying outside the nozzle, resulting in but relatively slight wear on said nozzle. This atomizing method also enabled a coal-water slurry to be atomized so effectively as to enable the slurry to be burned in the absence of a support or back-up flame, generated, for example, by burning oil.

In order to facilitate disintegration of the fuel flow, and in order to achieve a favourable spread pattern when practicing the method of the invention, the said first gas stream can advantageously be directed obliquely inwardly and forwardly relative the nozzle, and similarly the second gas stream may be advantageously directed obliquely outwardly and forwardly relative said nozzle. To the same end, at least one said fuel and gas streams may be given a turbulent motion about the geometric axis of the nozzle. At least one of the first and second gas streams may consist of an oxygen-containing gas, which then takes part in the combustion of the fuel, together with the air of combustion or like medium supplied especially for combustion purposes.

To the aforesaid end, a nozzle according to the invention is mainly characterized in that it comprises three substantially mutually concentric pipes or tubes which define an inner channel and an outer channel, of circular cross-section, for conducting the passage of air under pressure, and an intermediate channel or circular cross-section, for conducting the passage of liquid fuel, the outer channel exiting into the intermediate channel adjacent the outlet end of the nozzle, said intermediate channel, in turn, discharging from said nozzle., and in that the inner channel is provided in the region where it discharges with a deflector which, together with the inner pipe, defines a discharge means which is of circular cross-section and which is so outwardly curved that the stream of gas under pressure exiting through said discharge means is directed at an angle onto a stream of fuel-pressurized gas exiting from the intermediate channel and surrounding said flow of gas under pressure.

So that the invention will be more readily understood and further features and advantages thereof made apparent, an exemplary embodiment of a nozzle according to the invention will now be described with reference to the accompanying drawing, which is an axial sectional view of said nozzle.

In the drawing, the reference 1 identifies generally an elongate atomizing nozzle, which in the illustrated embodiment comprises three substantially mutually concentric pipes or tubes 2, 3 and 4, of which pipes the inner pipe 2 has an external screw thread at its rear end. Screwed onto the screw-threaded and of the pipe 2 is an end piece 5 having arranged thereon a connector stub 6 by means of which the pipe 2 can be connected to a source of gas under pressure, e.g. air at a pressure of 100–800 kPa.

The intermediate pipe 3 is screwed to the inner pipe 2 with the aid of an internally screw-threaded rear end piece 7, the pipes 2 and 3 being locked in selected positions relative to one another by means of a locknut 8 arranged to bear against the end piece 7. The pipe 3 is provided with a connector stub 9, through which a slurry-type fuel can be fed by means of a pump and supply lines (not shown).

The outer pipe 4 is fixedly welded to the outside of the pipe 3 via a rear end-piece (not referenced) and is provided with a connector stub 10 through which said pipe can be connected to a source of gas under pressure, which may be the same source as that connected to the pipe 2 through the connector 6. The forward end of the pipe 4 has an external screw thread, on which is screwed a forward end piece 11 which has arranged thereon an inwardly directed end flange 12. This flange, together with a forward chamfered surface 13 on the pipe 3, defines an obliquely inwardly and forwardly directed annular discharge orifice for a channel 14 of circular cross-section defined by the mutually opposing surfaces of the pipes 3 and 4, said orifice being located axially behind the forward end of the pipe 2.

Each of the pipes 2 and 3 is provided with respective radially extending projections or spacers, 15 and 16, by means of which the pipes 2, 3 and 4 can be held centred relative to one another. The pipes 2 and 3, together with the radial inner edge of the flange 12 of end piece 11, define a channel 17 of circular cross-section. The exit orifice of the channel 17 is located at 18, substantially axially in the front end surface of the nozzle 1, the channel 14 thus discharging into the channel 17 immediately in front of the forward, radially inwardly chamfered exit orifice of the pipe 3.

The pipe 12 forms an inner channel 19 and is provided in the region of its exit orifice with a deflector 20 which, together with a forward chamfered surface 21 on the pipe 2, forms a discharge means 22 which is of circular cross-section and which is so outwardly curved that the stream of pressurized gas exiting therefrom is directed angularly outwards towards a stream of fuel-pressurized gas which exits from the exit orifice 18 of channel 17 and which embraces said discharge means 22. As indicated by chain lines 23, the deflector 20 may extend forwardly, beyond the leading end of the pipe 2 and may have a radial extension such that its axial geometric projection towards the forward end of the nozzle 1 covers at least a part of the exit orifice of the pipe 3 and the exit orifice 18 of the channel 17. In the illustrated embodiment, the deflector 20 is mounted on the forward end of a rod 24 which is centered in the pipe 2 by spacers 25. The rod 24 has a screw-threaded rear end which is screwed into and through the end piece 5 of the pipe 2. The rod 24 and the pipe 2 are locked in a selected position relative to one another by means of a lock-nut 26, which is arranged to bear against the end piece 5. Formed in the rear end of the rod 24 is a slot or groove 27 into which a screwdriver or like tool can be fitted, the arrangement being such that when the nut 26 is slackened, the rod 24 can be rotated relative the pipe 2, in order to adjust the width of the exit orifice 22 to the desired orifice size. In a corresponding manner, the width of the exit orifice of channel 14 can be adjusted by rotating the end piece 11, which in the illustrated embodiment is arranged to co-act with a nut 28, which is arranged to bear against the rear end of the end piece 11, to lock said end piece to the pipe 4 in a selected position.

As indicated by reference 29, arranged on the rod 24 is a guide plate or like device which is positioned obliquely relative to the axial direction of the nozzle 1 and which imparts to the gas flowing through the channel 19 a turbulent movement relative to the geometric axis of the nozzle. Guide plates of like devices can be arranged in a similar manner in channels 14 and/or 17, so as to impart to the media flowing through said channel or channels a turbulent motion relative the geometric axis of the nozzle.

As before mentioned, when using the nozzle 1 a slurry comprising preferably solid fuel particles, such as particles of coal, and a liquid, such as water, is passed to the nozzle through the connector 9, while gas under pressure is supplied to said nozzle through the connectors 6 and 10. When the stream of slurry, said stream having a circular cross-section, leaves the exit orifice of pipe 3 during its passage through the channel 17, the outside of said stream comes into contact with the stream of gas under pressure exiting from the channel 14, said gas under pressure stream thus accelerating and preliminarily disintegrating the slurry stream. The thus accelerated and preliminarily disintegrated slurry stream appears in mixture with the gas under pressure exiting from the channel 14, in the form of a stream of circular cross-section exiting from the orifice 18 of the channel 17, and is there met by the obliquely, outwardly directed pressurized-gas stream of circular cross-section exiting from the orifice 22 of the channel 19, whereupon atomization of the fuel slurry is introduced and completed with the minimum of contact between the wearing, solid fuel particles of the slurry and the nozzle surfaces. The fuel is atomized particularly effectively, which enables carbon-water slurries to be burned without requiring simultaneous back-up combustion with the aid, for example, of oil.

The drawing illustrates a normal arrangement of a fuel-atomizing or fuel-dividing nozzle 1 in a combustion plant. Thus, the reference 30 identifies an internal wall of a combustion chamber covered with boiler tubes 31. The nozzle 1 projects into an opening 32 in the wall 30, said opening being lined with a refractory, ceramic liner 33, while connected to the opening is a pipe 34 through which an oxygen-containing gas, such as air at an over pressure of 1–30 kPa is supplied. At the least the major part of the oxygen required for the combustion process is supplied through the pipe 34, and the gas under pressure used to atomize the fuel in nozzle 1 can well be an inert gas or a gas which will not support the combustion process.

As will be understood, the invention is not restricted to the described and illustrated embodiment, and that the illustrated method and nozzle can be modified in many ways within the scope of the invention as defined in the claims.

I claim:

1. A method for atomizing coal-water slurry or coal-oil slurry fuel, the fuel being brought together with a gas under pressure in an atomizing nozzle, which comprises passing a continuous stream of fuel through a channel of circular cross-section, and accelerating and preliminarily disintegrating said fuel flow at a location adjacent the outlet end of the nozzle by means of at least one first stream of gas under pressure directed inwardly against the outside of the stream of fuel, and by finally atomizing said fuel by directing at least one second stream of gas under pressure outwardly against the inside of the accelerated and preliminarily disintegrated fuel stream, substantially immediately after said fuel stream leaves said nozzle.

2. A method according to claim 1, wherein said first gas stream is directed obliquely inwardly and forwardly relative said nozzle.

3. A method according to claim 1 wherein the second gas stream is directed obliquely outwardly and forwardly relative to said nozzle.

4. A method according to one of claims 1, 2 or 3, wherein at least one of said first and second streams consists of an oxygen-containing gas.

5. A method according to claim 1, 2 or 3 wherein at least one of said fuel stream and said gas stream is imparted in a turbulent motion around the geometric center of the nozzle.

* * * * *